US007404218B2

(12) United States Patent
Tade

(10) Patent No.: US 7,404,218 B2
(45) Date of Patent: Jul. 29, 2008

(54) ADVERTISEMENT DISPLAY FOR TOILET OVERFLOW TUBE

(76) Inventor: Richard L. Tade, 256 N. Pinecrest, Wichita, KS (US) 67208

( * ) Notice: Subject to any disclaimer, the term of this patent is extended or adjusted under 35 U.S.C. 154(b) by 512 days.

(21) Appl. No.: 10/904,819

(22) Filed: Nov. 30, 2004

(65) Prior Publication Data

US 2006/0112484 A1 Jun. 1, 2006

(51) Int. Cl.
*A47K 17/00* (2006.01)

(52) U.S. Cl. ..... 4/661

(58) Field of Classification Search ..... 4/391, 4/661; 40/390, 584
See application file for complete search history.

(56) References Cited

U.S. PATENT DOCUMENTS 1,632,475 A * 6/1927 Hoefler ..... 40/309
2,701,702 A * 2/1955 Diederich ..... 4/661
3,385,317 A * 5/1968 Yankers ..... 4/391
4,367,605 A * 1/1983 Clifton ..... 40/584
5,010,667 A * 4/1991 Hassinger ..... 40/309
6,873,263 B1 * 3/2005 Hohman ..... 340/602

* cited by examiner

*Primary Examiner*—Tuan N Nguyen
(74) *Attorney, Agent, or Firm*—Hovey Williams LLP

(57) ABSTRACT

An advertising placard unit (36) for use within a toilet tank (20) is provided. The unit (36) includes an advertising information-bearing placard (40, 40*a*) and connection structure (42, 50, 56) allowing secure coupling of the unit (36) onto an overflow tube (30) forming a part of the tank flush valve assembly (22). Preferably, the placard (40, 40*a*) is supported in an upstanding, oblique orientation above the tube (30) in such a manner as to not interfere with valve operation or placement of a lid (24) on the tank (20).

10 Claims, 5 Drawing Sheets

ADVERTISEMENT DISPLAY FOR TOILET OVERFLOW TUBE

BACKGROUND OF THE INVENTION

1. Field of the Invention

The present invention is broadly concerned with advertising placard units especially designed for use in conventional toilet tanks so as to provide a means of displaying advertising information about plumbing services. More particularly, the invention is preferably concerned with such placard units, and the combination thereof with an upstanding overflow tube forming a part of a toilet tank valve, wherein the placard unit includes an advertising information-bearing placard together with connection structure for securely coupling the unit to the overflow tube.

2. Description of the Prior Art

Conventional household flush toilets are equipped with an upright, lidded water tank having therein a selectively operable flush valve assembly. The valve assembly may be of various designs, but includes a valve as well as an upstanding overflow tube which prevents flooding in the event that the valve does not close.

These flush toilets invariably require service from time to time in order to maintain them in working order. To give one example, the valve may become warn and continuously leak water. The first reaction of a homeowner to such a problem is to lift the toilet tank lid to examine the valve and attempt adjustments. Often however, an unskilled homeowner may be ill-equipped to deal with the problem and may conclude that the services of a professional plumber are needed. Because plumbing services of this nature are only infrequently needed, the homeowner must refer to a telephone or other service directory in order to obtain the telephone number and other pertinent information of a plumbing service company. Heretofore, there has been no way to display advertising or other information about plumbing services within the toilet tank itself, so as to facilitate a homeowner's contact with a plumbing service company.

SUMMARY OF THE INVENTION

The present invention overcomes the problems outlined above, and provides an advertising placard unit especially designed for mounting within the tank of an otherwise conventional flush toilet, in order to provide plumbing service information. Broadly speaking, the placard unit of the invention includes an advertising information-bearing placard and connection structure coupled with the placard for attachment of the unit to a stationary component of the flush valve, e.g., the top of the valve itself or to the upper end of the toilet tank overflow tube. In this way, the homeowner will immediately perceive the advertising information upon lifting the tank lid, which both assists the homeowner and provides a valuable advertising tool for a plumbing service company.

The placard unit is preferably formed of a water-resistant synthetic resin material and the advertising information may be imprinted or embossed on the placard. A variety of connection structures may be employed, for example friction pins, arcuate gripping bands or spring-loaded alligator clips. Whatever connection structure is used, it is preferred that the placard be maintained in an upright, oblique orientation substantially above the maximum water level within the tank. Moreover, it is important that the placard unit not interfere with tank valve operation or obstruct placement of the tank lid.

Other aspects and advantages of the present invention will be apparent from the following detailed description of the preferred embodiments and the accompanying drawing figures.

BRIEF DESCRIPTION OF THE DRAWINGS

Preferred embodiments of the invention are described in detail below with reference to the attached drawing figures, wherein.

DETAILED DESCRIPTION OF THE PREFERRED EMBODIMENT

Figure 1:
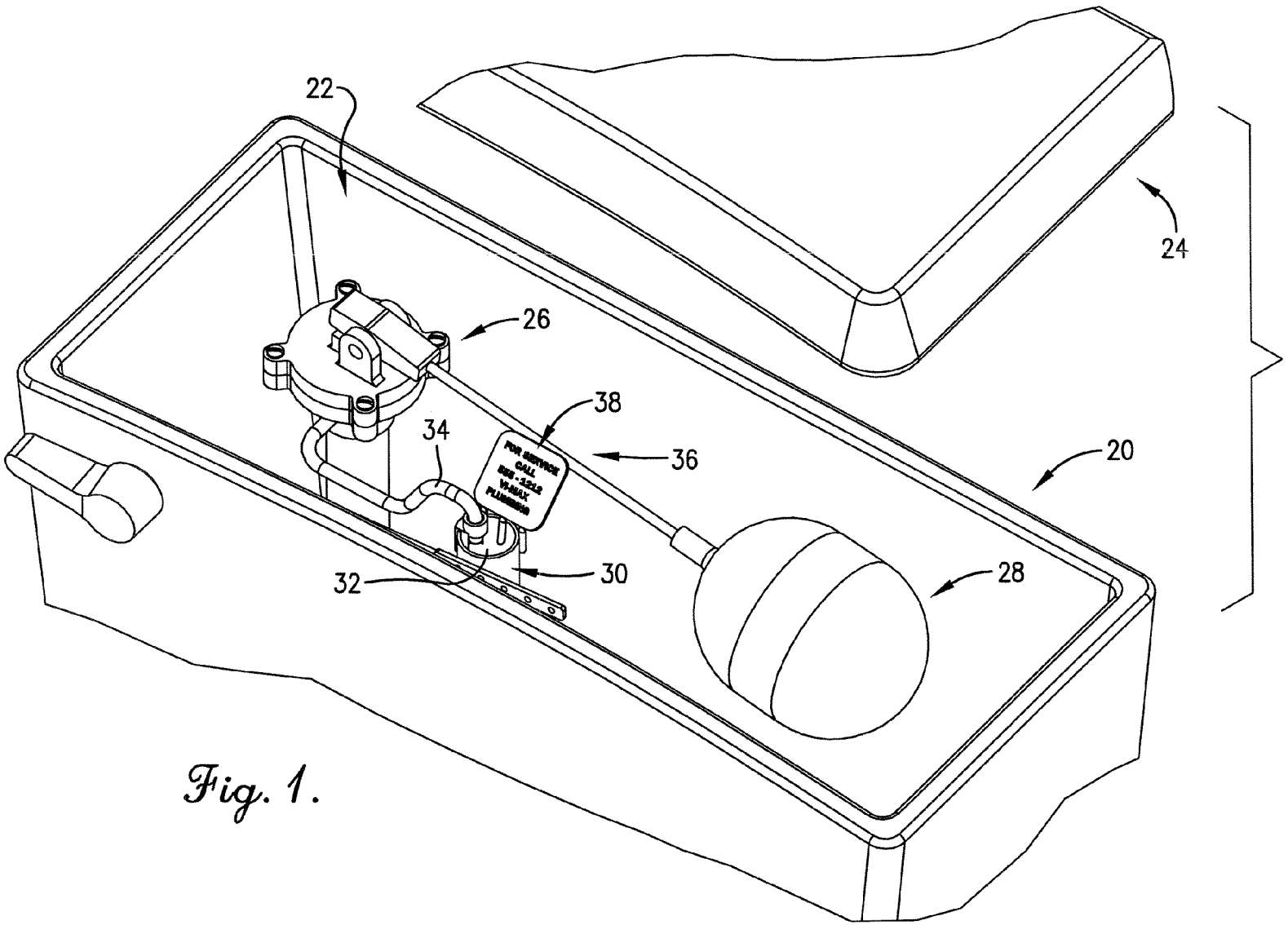
FIG. 1 is a fragmentary, exploded, isometric view of a toilet tank equipped with a conventional valve assembly and having a placard unit in accordance with the invention operatively coupled to the upper end of the valve assembly overflow tube.
Figure 2:
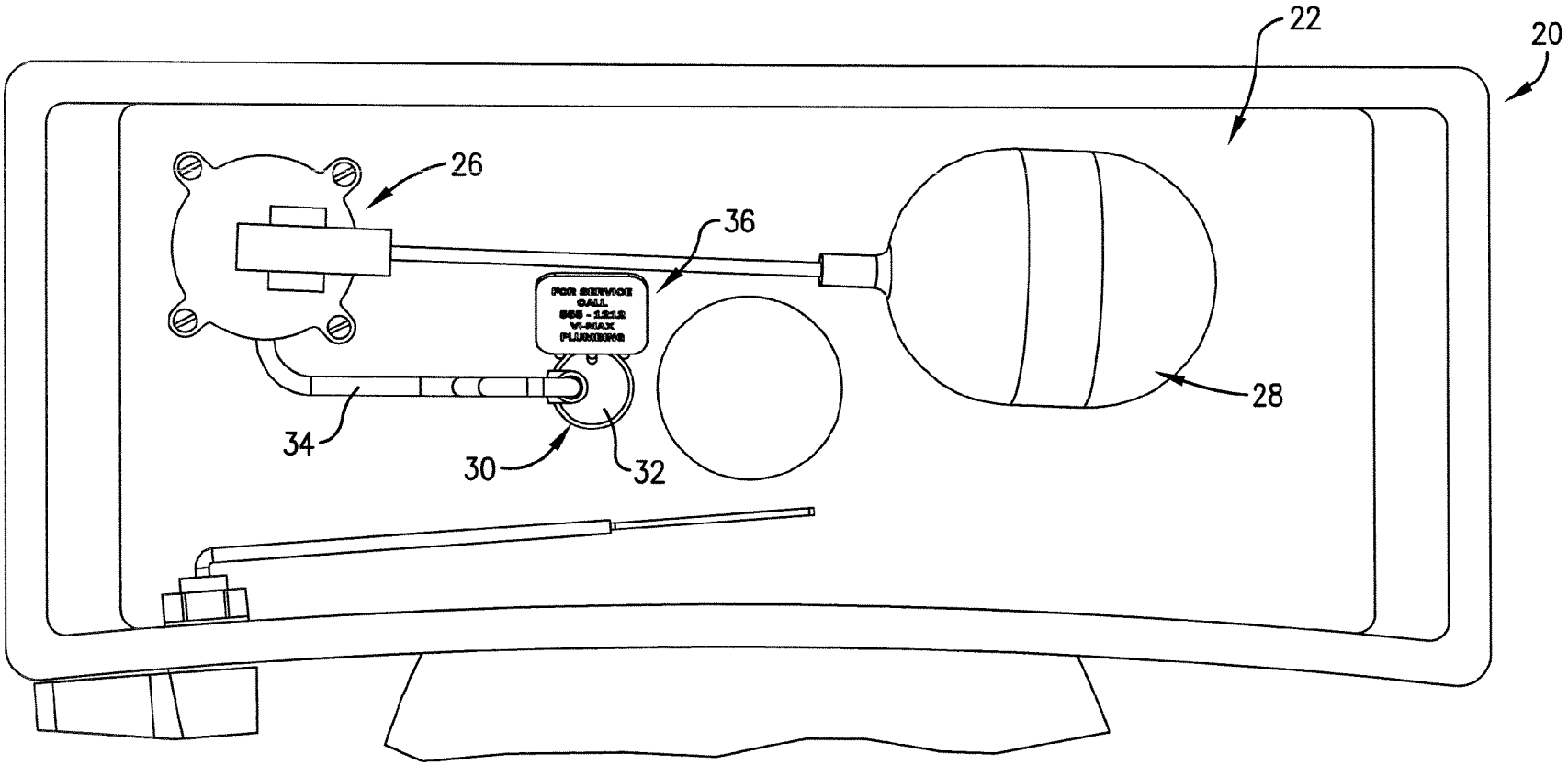
FIG. 2 is a fragmentary plan view illustrating the toilet tank, valve assembly and placard unit of FIG. 1.

Turning now to the drawings, FIGS. 1-2 illustrate a conventional toilet tank 20 having therein a valve assembly 22 and a closure lid 24. The assembly 22 includes a valve 26 operable by means of a float 28. The overall assembly 22 further includes an upstanding overflow tube 30 presenting an upper open end 32. A flexible tube 34 extends between valve 26 and communicates with the interior of overflow tube 30. Those skilled in the art will appreciate that the assembly 22 is itself entirely conventional, and that other valve assembly designs could be used in lieu of that shown, all of which would preferably include the overflow tube 30.

Figure 3:
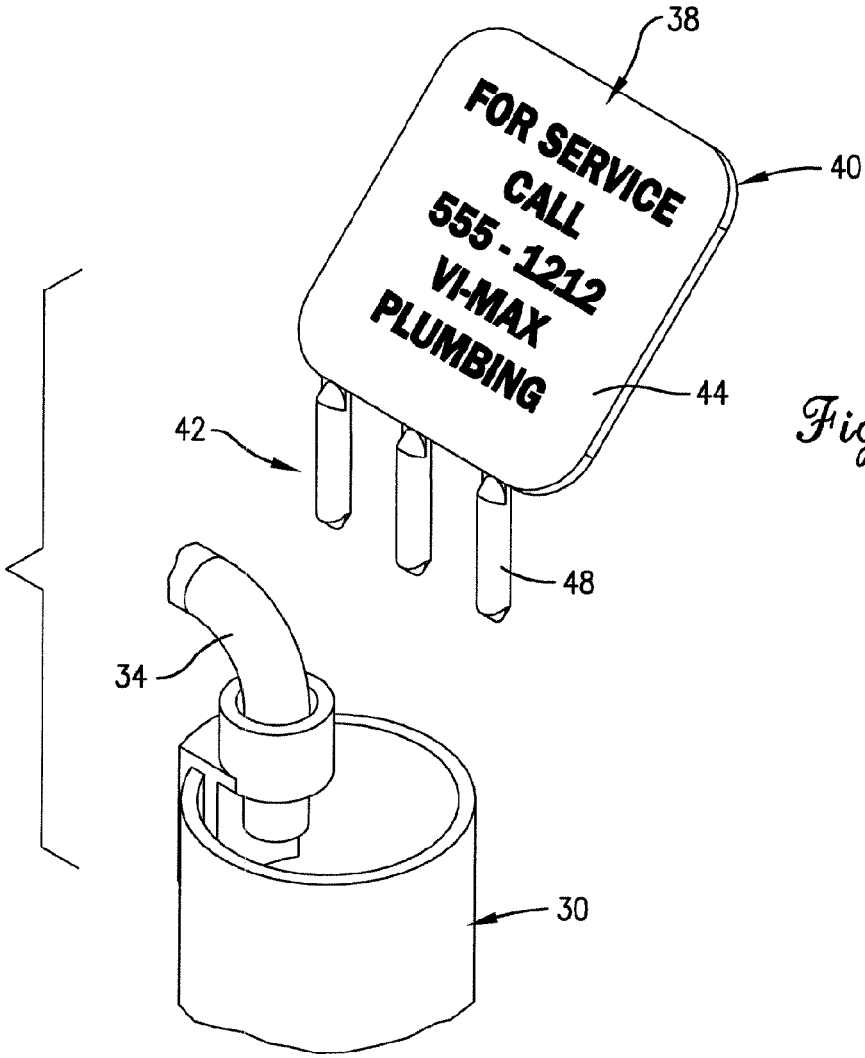
FIG. 3 is an enlarged, exploded view illustrating a preferred placard unit prior to attachment thereof to the upper end of an overflow tube.
Figure 5:
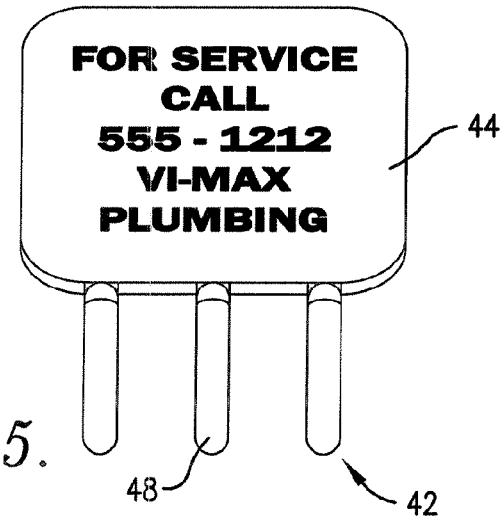
FIG. 5 is an elevational view of the placard unit of FIG. 4.
Figure 4:
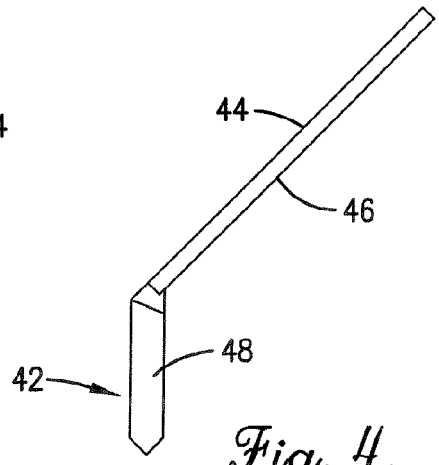
FIG. 4 is a side view of the placard unit of FIG. 3.

Again referring to FIGS. 1 and 2, it will be seen that a placard unit 36 is operatively mounted on the upper end of tube 30 and is provided with advertising information 38, preferably describing plumbing services. The placard unit 36 broadly includes a planar placard 40 as well as connection structure 42 for coupling the placard to the upper end of tube 30 (see FIGS. 3-5). In the embodiment shown in FIGS. 1-5, placard 40 has opposed front and rear faces 44, 46, with the face 44 bearing the information 38. The connection structure 42 is in the form of three depending, laterally spaced apart pins 48 which are connected to the bottom margin of placard 40 and are designed to interfit with the upper end of tube 30 to hold the unit 36 in place. As best seen in FIGS. 1 and 2, the central pin 48 is oriented for receipt within the confines of tube 30, while the outboard pins 48 engage the outer surface of the tube 30.

It will be seen that the placard unit is designed so that the placard 40 is in an upstanding, obliquely oriented relationship relative to the vertical axis of tube 30 and is moreover substantially completely above the maximum water level within tank 20. In addition, it is preferred that the entire unit 36 be formed such as by injection molding of a suitable synthetic resin material which is substantially resistant or impervious to water and the humid conditions within tank 20 (e.g., polyethylene, polypropylene, polyurethane, PVC, etc.). It is also important that the placard unit not interfere with the operation of valve 26 or obstruct placement of lid 24 on tank 20. To this end, it is preferred that the vertical height of the placard 40 be no more than about 3 inches.

When the unit 36 is positioned on the upper end of tube 30 as shown, a homeowner will immediately perceive the information on placard 40 when tank lid 24 is removed. The oblique orientation of the placard 40 permits easy reading of the service information, and makes it a simple matter for the homeowner to call the plumbing service referred to on the placard.

Figure 6:
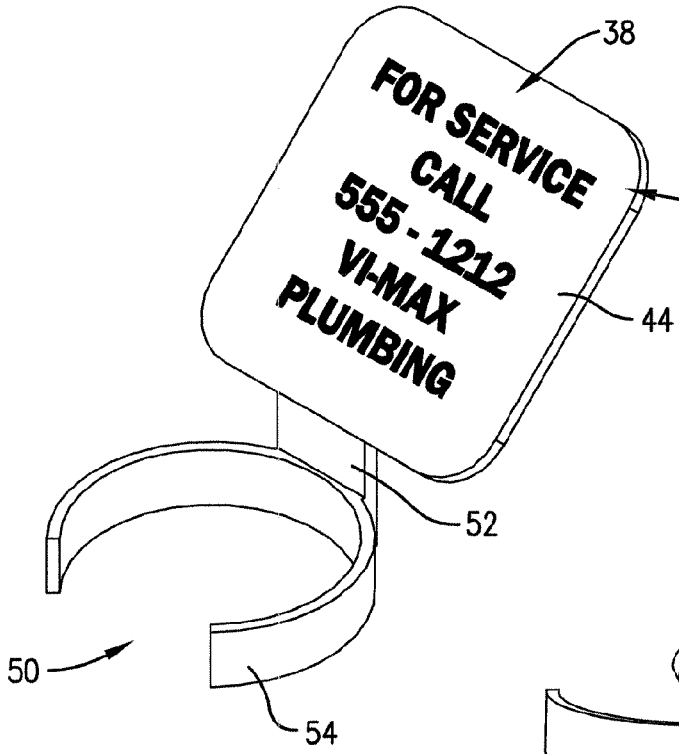
FIG. 6 is an isometric view of another placard unit in accordance with the invention, showing the advertising information-bearing surface of the unit.
Figure 7:
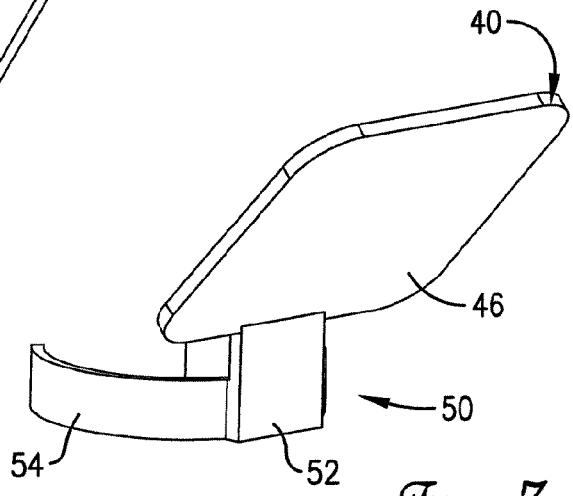
FIG. 7 is an isometric view illustrating the rearward surface of the unit depicted in FIG. 6.
Figure 8:
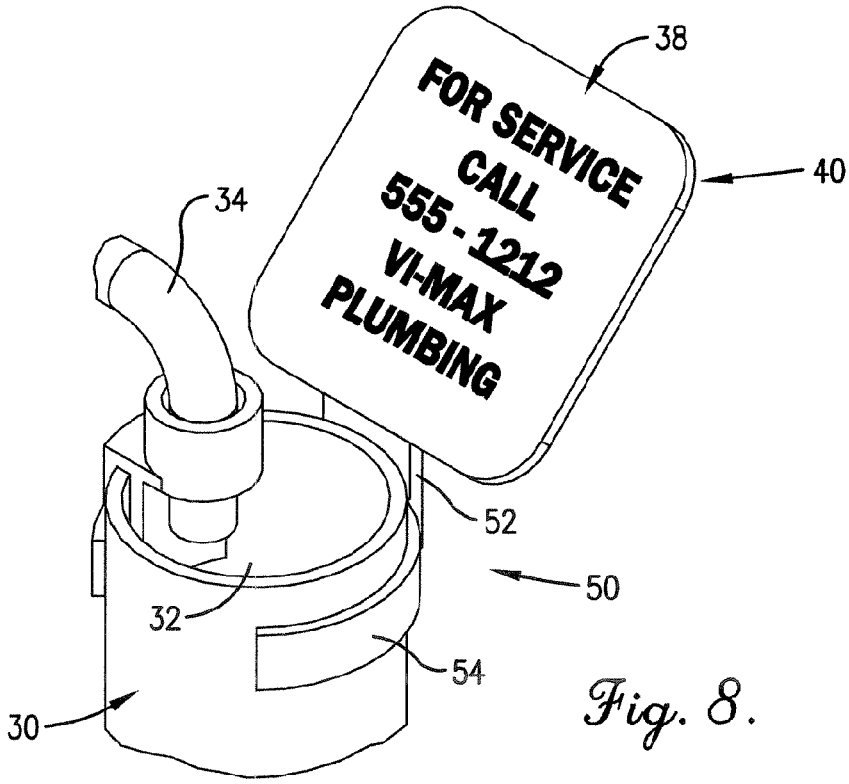
FIG. 8 is an isometric view illustrating the placard unit of FIGS. 6 and 7 operatively installed on the upper end of an overflow tube.

While the multiple-pin attachment structure 42 is in some instances preferred, the invention is not limited to this design. Indeed, essentially any connection structure may be employed so long as the placard unit does not interfere with operation of the toilet valve assembly or obstruct lid placement. An exemplary alternative connection structure 50 is shown in FIGS. 6-8, in the form of a depending leg 52 supporting a resilient ring section 54. In this embodiment, the ring section 54 is designed to grip the outer surface of tube 30 as shown in FIG. 8, in order to maintain the placard 40 in place. Here again, in this design the placard 40 and connection structure 50 are preferably integrally formed of a suitable synthetic resin material. The ring section 54 is preferably flexible and snaps onto the tube 30.

Figure 9:
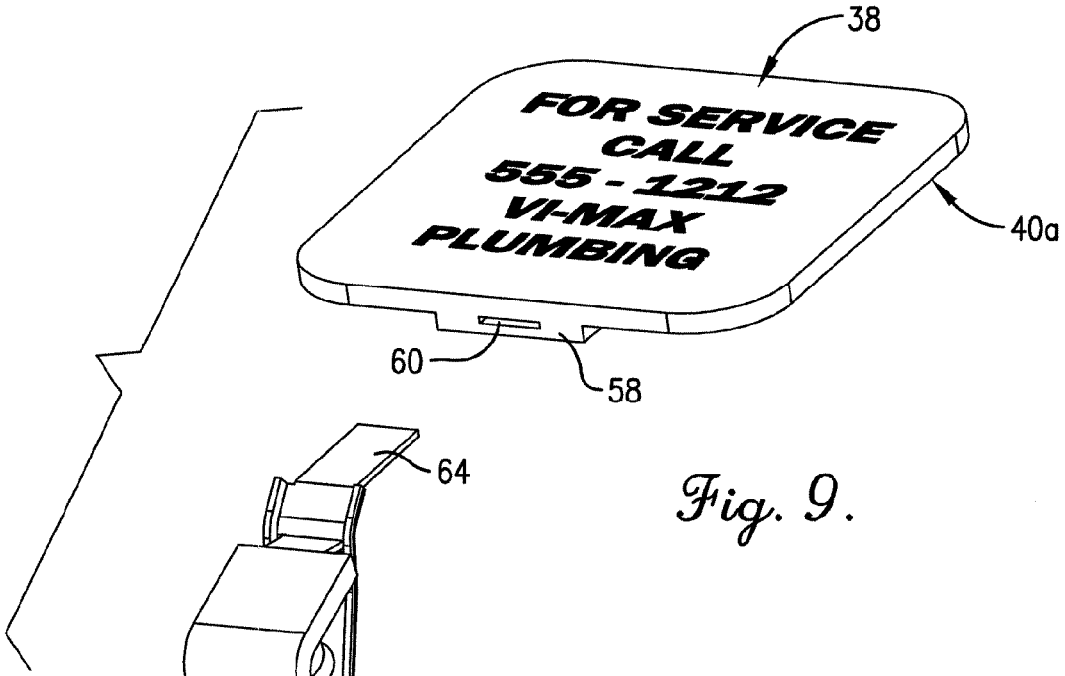
FIG. 9 is an exploded view illustrating another placard unit in accordance with the invention, making use of a detachable alligator clip connection structure.
Figure 10:
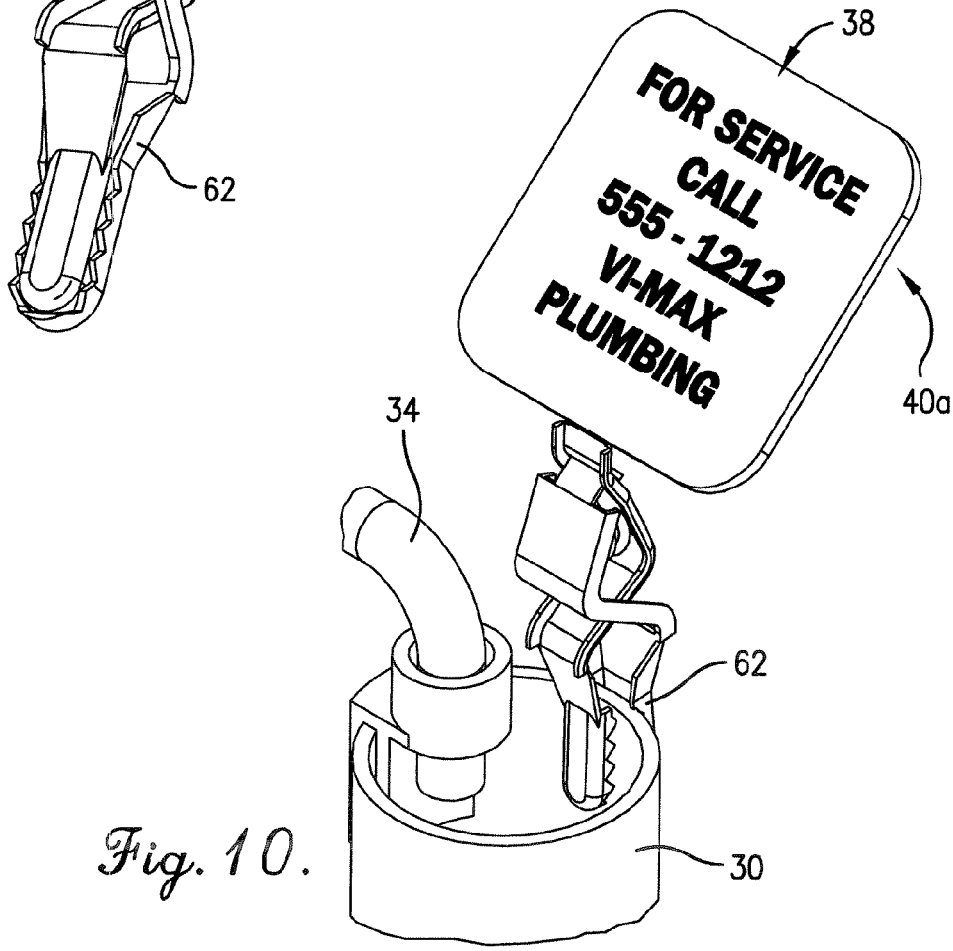
FIG. 10 is a perspective view similar to that of FIG. 8, but showing the placement of the placard unit of FIG. 9 on the upper end of the overflow tube.

FIGS. 9-10 illustrate another embodiment, including a placard 40*a* and connection structure 56. The placard 40*a* is identical to placard 40 except that it is equipped with a rearmost block 58 provided with a slot 60. The connection structure 56 is in the form of a spring-loaded alligator clip 62 having an attachment tongue 64. In use, the tongue 64 is inserted within slot 60 to complete the overall unit. In order to install this embodiment, the alligator clip 62 is opened and the jaws thereof receive the upper end of tube 30 (FIG. 10). This assures a secure connection for the placard unit.

While the invention has been shown in the drawings in the form of a placard unit designed for attachment to the upper end of an overflow tube, the invention is not so limited. For example, a properly configured placard unit could be mounted atop valve 26 or to any other essentially stationary component of the flush valve.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A combination comprising:

a toilet tank overflow tube situated within a lidded toilet tank;

an advertising placard unit comprising an advertising information-bearing placard and connection structure operably coupled with the placard, said placard presenting a substantially flat face having said advertising information imprinted thereon, said connection structure operably engaging said tube to support said placard in an upstanding relationship relative to the tube and maintain the placard in an orientation permitting reading of said information thereon, said connection structure supporting the face of the placard in an oblique orientation relative to a longitudinal axis of said tube, so that the face is visible forwardly and upwardly from the tank.

2. The combination of claim 1, said placard being substantially planar.

3. The combination of claim 1, said placard having a vertical height permitting unobstructed placement of said lid on said tank.

4. The combination of claim 3, said placard having a vertical height of no more than about 3 inches.

5. The combination of claim 1, said placard unit being formed of a synthetic resin material substantially resistant to water and humid conditions within said tank.

6. The combination of claim 1, said tube presenting an upper open end, said connection structure comprising a plurality of pin members depending from said placard and oriented for interfitting with said tube upper end.

7. The combination of claim 1, said tube presenting an outer surface, said connection structure comprising a resilient band for gripping the outer surface of said tube.

8. The combination of claim 1, said connection structure comprising an alligator clip.

9. The combination of claim 1, said connection structure being detachably coupled with said placard.

10. The combination of claim 1, said advertising information including information about plumbing services.

* * * * *